US007154402B2

(12) United States Patent
Dayoub

(10) Patent No.: US 7,154,402 B2
(45) Date of Patent: Dec. 26, 2006

(54) POWER STRIP WITH SMOKE DETECTION AUTO-SHUTOFF

(76) Inventor: Michael Dayoub, 2625 Bethany Creek Ct., Alpharetta, GA (US) 30004

( * ) Notice: Subject to any disclaimer, the term of this patent is extended or adjusted under 35 U.S.C. 154(b) by 170 days.

(21) Appl. No.: 10/768,793

(22) Filed: Jan. 29, 2004

(65) Prior Publication Data

US 2005/0168901 A1 Aug. 4, 2005

(51) Int. Cl.

| | |
|---|---|
| ***G08B 17/10*** | (2006.01) |
| ***H01H 73/00*** | (2006.01) |
| ***H01R 25/00*** | (2006.01) |
| ***H01R 27/02*** | (2006.01) |
| ***H01R 13/10*** | (2006.01) |

(52) U.S. Cl. ..... 340/628; 340/629; 340/630; 340/631; 340/632; 361/115; 361/116; 439/638; 439/650; 439/652; 439/682

(58) Field of Classification Search ..... 340/628–632; 361/115, 116; 439/501, 682, 638–655
See application file for complete search history.

(56) References Cited

U.S. PATENT DOCUMENTS

| | | | | |
|---|---|---|---|---|
| 5,508,568 | A * | 4/1996 | Mammen | 307/117 |
| 5,617,077 | A * | 4/1997 | Wiemeyer et al. | 340/628 |
| 5,625,345 | A * | 4/1997 | Stark et al. | 340/628 |
| 6,225,910 | B1 * | 5/2001 | Kadwell et al. | 340/630 |
| 6,380,852 | B1 * | 4/2002 | Hartman et al. | 340/521 |
| 6,666,712 | B1 * | 12/2003 | Kramer | 439/501 |
| 2001/0046815 | A1 * | 11/2001 | Luu | 439/682 |
| 2004/0142601 | A1 * | 7/2004 | Luu | 439/652 |

* cited by examiner

*Primary Examiner*—Daniel Wu
*Assistant Examiner*—Lam Pham
(74) *Attorney, Agent, or Firm*—Hill, Kertscher & Wharton, LLP; Katherine Lahnstein, Esq.; Matthew Durell, Esq.

(57) ABSTRACT

The invention is a power strip with an internal smoke detection device, which cuts off AC electrical power to attached electrical devices if smoke is detected.

15 Claims, 3 Drawing Sheets

POWER STRIP WITH SMOKE DETECTION AUTO-SHUTOFF

CROSS REFERENCE TO RELATED APPLICATION

None

BACKGROUND OF THE INVENTION

The invention's purpose is to provide an A/C (alternating current) power supply which cuts off power to attached electrical devices if smoke is detected. The invention must do so without the need for signals from remote smoke detectors or monitoring equipment.

The need for the invention arose from a spate of fires in Georgia in unattended settings. Those settings could not afford expensive security and fire monitoring services. They were barns, greenhouses and cabins where alarms would not be heard but where space heaters were used to prevent temperature damage to plants, animals, equipment, or other property. Other attended and unattended settings may also benefit from use of the invention. For example, the invention may also be used in conjunction with a monitoring service, when quick shutoff is needed of equipment such as ventilation fans or other fire dangers.

SUMMARY OF THE INVENTION

The invention is a power strip with an internal smoke detection device, which cuts off alternating current ("A/C" or AC) power AC electrical power to attached electrical devices if smoke is detected. The invention does so without the need for signals from remote smoke detectors or monitoring equipment. Power flows through the power strip to user AC outlets, unless smoke is detected, at which point the smoke detector creates a trigger voltage, shutting off power to the outlets.

DETAILED DESCRIPTION OF THE PREFERRED EMBODIMENT

Figure 1:
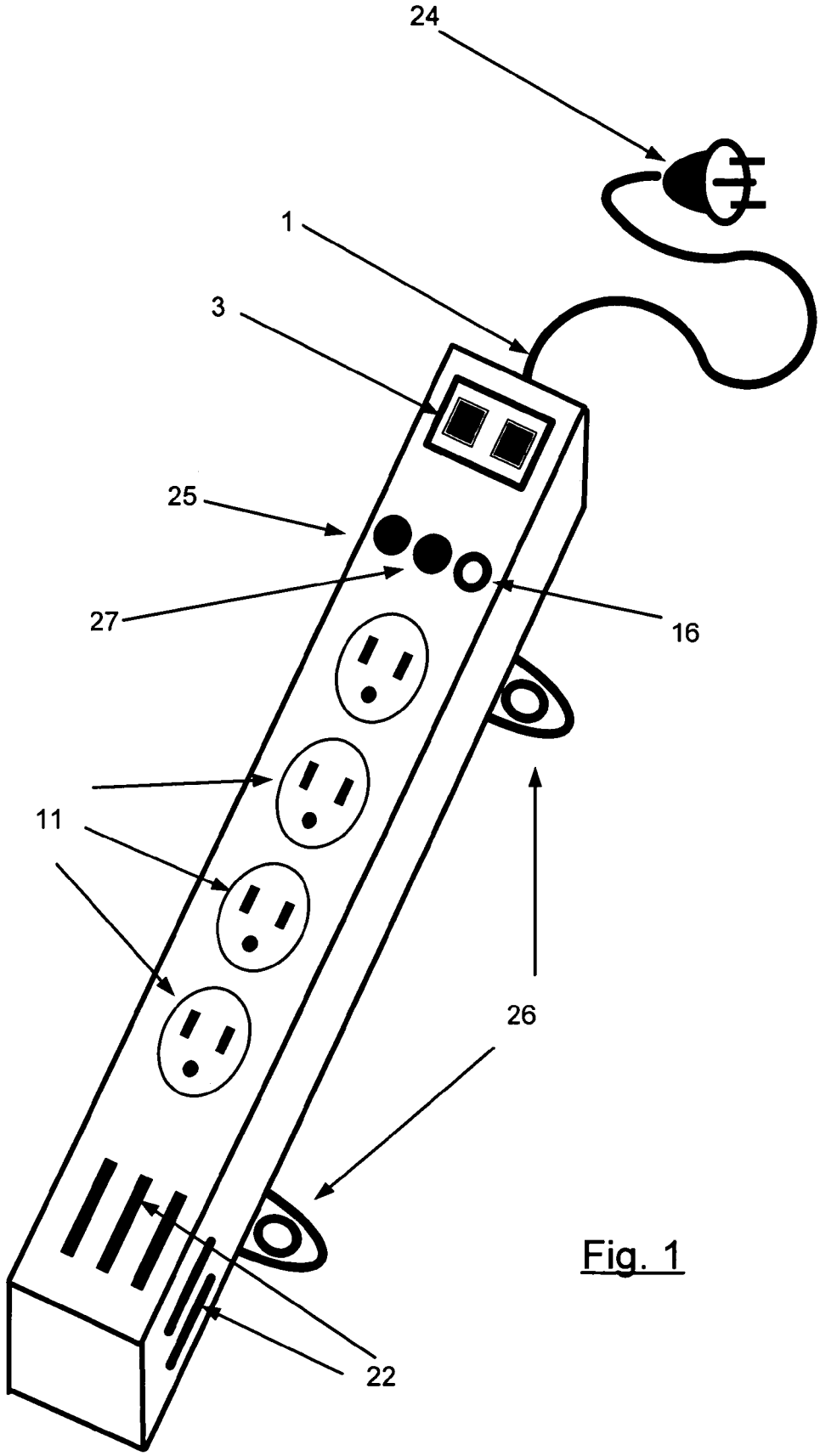
FIG. 1 is an external illustration of the casing, commonly referred to as a power strip, for the invention.

Beginning with FIG. 1, the smoke detecting power strip appears much like any power strip with a noticeable difference being Smoke Detector Vent Holes 22 on the housing which allows air into the enclosure for the purpose of smoke detection. The invention consists of housing for the power receptacles and electronic components, a power cord with a plug to receive supplied AC power 1, and User AC plugs 11 to provide power to other devices plugged into the invention.

The preferred embodiment of the housing is a metal box or strip with one or more User AC plugs 11. (such as NEMA 5-15R, for example) for equipment to plug in and receive A/C power. The housing contains an ON/OFF switch 3 to manually halt or enable power to attached devices. The housing contains one or more Reset switches 25 to re-enable power to those devices after a power surge, electrical short, or smoke is detected. An optional light emitting diode ("LED") LED indicator 16 on the housing can be provided to show detection of smoke. Furthermore, a smoke detector test button 27 may be included as an optional feature. An electrical cord from the box or strip and a male A/C plug 24 is used to attach the power strip to standard 120V AC power outlet. It will be obvious to those skilled in the art that the invention can be manufactured to operate with any other AC voltage, including without limitation 220V AC.

In its preferred embodiment the invention's housing has mounting holes 26 to allow the housing to be mounted on a surface above possible combustible material or machinery. This optimizes the smoke detecting potential and reduces the possibility of liquids entering the housing through the Smoke Detector Vent Holes 22 during floods or other mishaps.

It will be obvious to those skilled in the art that the number or configuration of AC sockets is nonessential to the invention. One or two or more rows of User AC outlets 11 can be used to accommodate the needs of the industry or consumer. Moreover, industry producers may choose to include surge protection, a ground fault ("GF") GF circuit breaker, an audible smoke alarm, a Smoke Detected indicator light, a Power ON/OFF indicator light, a Test switch for smoke detector, a Test switch for GF circuit breaker or any other accoutrement common to either a power strip, an uninterruptible power supply ("UPS") a UPS, or a smoke detection device.

Figure 2:
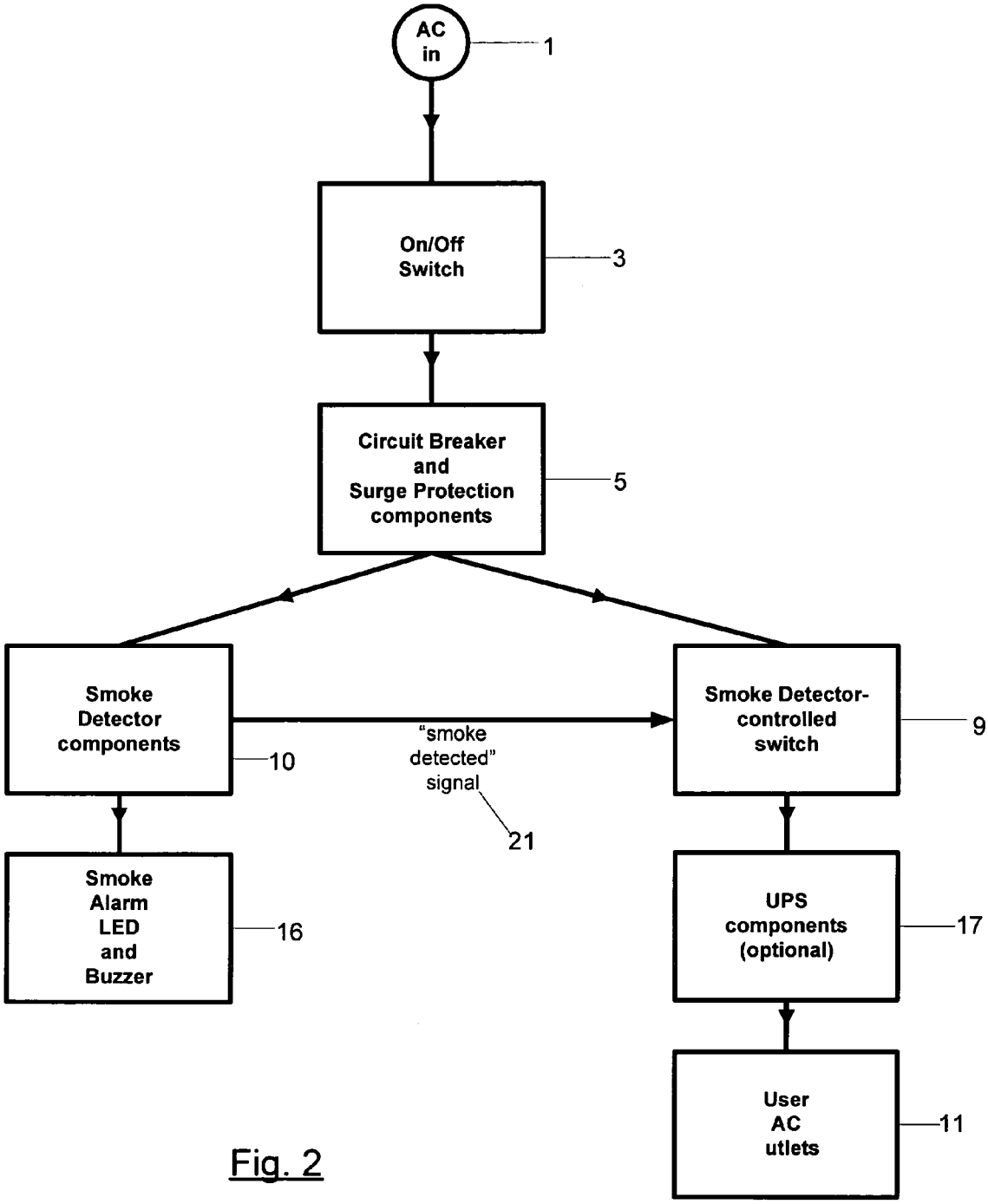
FIG. 2 is a block diagram of the electronic flow within the casing (power strip) for the invention.

Turning to FIG. 2, input AC power 1 is routed first through a main power ON/OFF switch 3 and a ground fault circuit breaker 5. For ground fault and circuit overload protection, a typical off-the-shelf ground fault circuit breaker 5 such as Hwawon Electronic's HW-15-MB would be suitable, but industry producers could use any such ground fault and circuit overload protection as would be appropriate to their target consumers' needs.

AC power is conducted to both the smoke detector components 10 and a smoke detector-controlled switch 9 which is controlled by the invention's Smoke Detector Components 10. In its preferred embodiment the smoke detector-controlled switch 9 is a mechanical relay such as NTE Electronic Inc.'s R25-5A16-120 16 Amp 120V AC SPDT relay but it could be any other type of electronically controlled switch. When the smoke detector-controlled switch 9 is in the closed state, AC power is conducted through smoke detector-controlled switch 9 to the User AC outlets 11.

If provided, UPS components 17 are placed in the invention's housing, electrically located between the Smoke Detector controlled switch 9 and the User AC outlets 11. When the smoke detector-controlled switch 9 is in the closed state, AC power is conducted through smoke detector-controlled switch 9 to the UPS components 17 and then through the UPS components 17 to the User AC outlets 11.

It will be obvious to those skilled in the art that placement strategies and electromagnetic shielding could be used in the preferred embodiment to protect electrical components from disruptive electrical fields generated during the relay's switch action without affecting the invention. It will further be obvious to those skilled in the art that all UPS functionality of the invention can be implemented with widely available hardware and battery cell technology, and is immaterial to the novelty of the invention. The novelty of the invention does not depend on a specified power rating or duration of UPS battery function.

Figure 3:
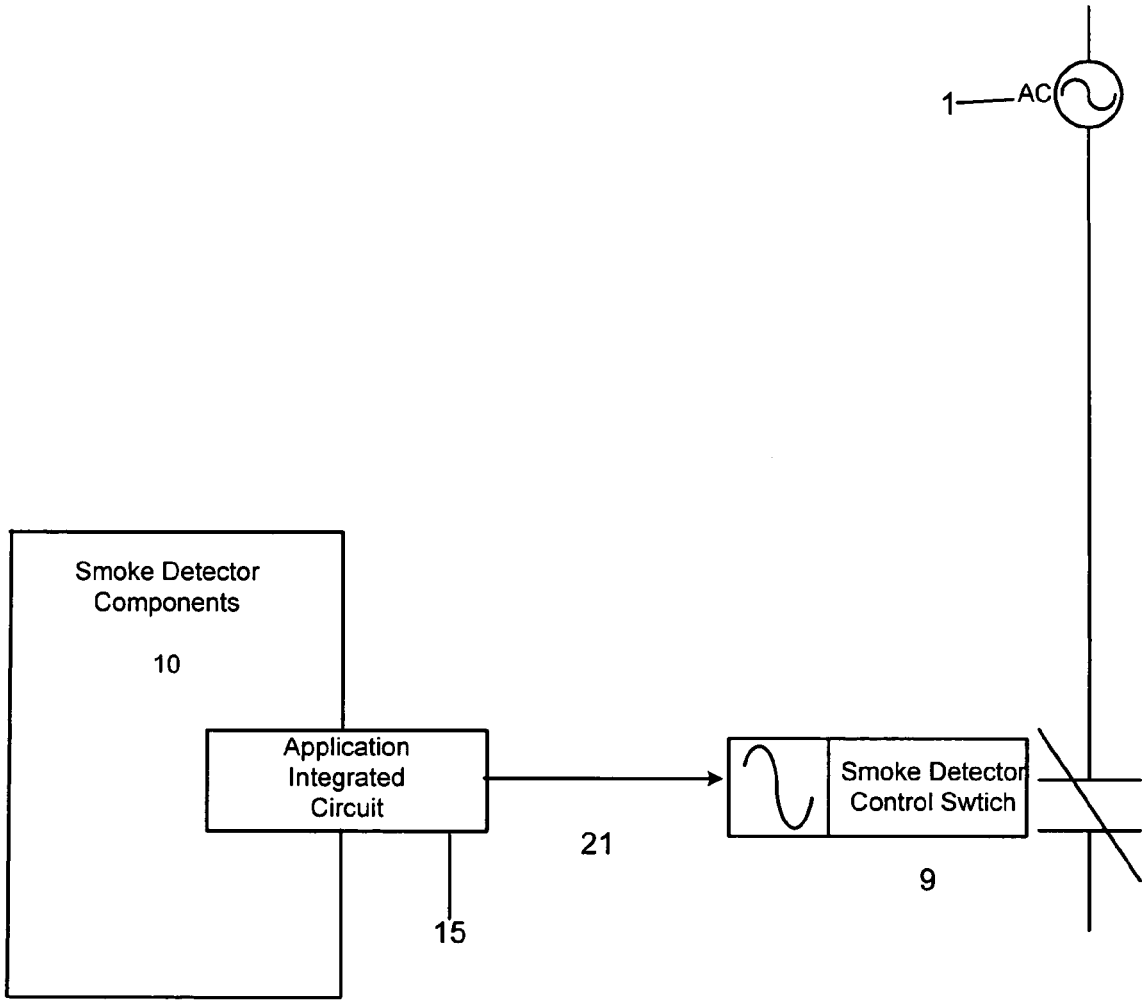
FIG. 3 illustrates the interaction of the trigger voltage with the smoke detector controlled switch to shut off AC power.

Now looking at FIG. 3, the smoke detector components 10 draw AC power for smoke detection and logic purposes. In its preferred embodiment, smoke detector components 10 constitute a photodiode smoke detector. In such a photodiode smoke detector, when smoke is present between the emitter and photodiode, the photodiode senses additional scattered light which causes the photodiode to pass additional current to the application integrated circuit 15. The application integrated circuit 15 is a commercially available integrated circuit which amplifies the current from the photodiode and executes its algorithm to determine whether to output alarm conditions to buzzers and LED's or other electrical devices.

Upon detection of smoke, Smoke Detector components 10 cause application integrated circuit 15 to emit trigger voltage 21, causing Smoke Detector controlled switch 9 to go into the open position. If there are no UPS components 17, then the Smoke Detector controlled switch 9 in the open position interrupts the flow of AC power to User AC outlets 11.

If UPS components 17 are present, then when the Smoke Detector controlled switch 9 goes into the open position, AC power to the UPS components 17 is stopped. In its preferred embodiment the UPS components 17 contain a separate logic chip which is set to disable AC power to the User AC ports 11 on presence of the trigger voltage 21 from the smoke detector block's application integrated circuit 15.

It will be obvious to those skilled in the art that the smoke detection technology selected is immaterial to the patent. In its preferred embodiment as described above, the method is detection of infrared light scattered by smoke. Other known smoke detector technologies commercially available and practical for use in the invention are Ionization detection and beam interference detection. The invention could exploit other technologies, whether in existence and unknown to the invention or those developed or improved in the future, without affecting the novelty of the invention.

As will be apparent to one of ordinary skill in the art, the foregoing describes the preferred embodiment of the invention, but there are doubtless modifications, alterations or adaptations of the preferred embodiment. It is the inventor's intention to claim all such modifications, alterations and adaptations within the spirit and scope defined in the following claims.

Mindful of the foregoing, I claim:

1. A power strip comprising:

a power cord being equipped with two or more prongs for connecting to a power outlet; and a single housing having a plurality of A/C power outlets disposed therein, the single housing enclosing a smoke detector and a smoke detection control switch.

2. The power strip of claim 1, wherein the single housing further encloses at least one of surge protection circuitry or a circuit breaker.

3. The power strip of claim 1, wherein the smoke detector is selected from the group comprised of at least one of an ionization sensor smoke detector, a photodiode sensor smoke detector and a beam interference smoke detector.

4. The power strip of claim 1, wherein the smoke detector includes an audible alarm.

5. The power strip of claim 1, wherein the single housing further includes at least one of:

ventilation holes suitable to allow smoke to penetrate the single housing;

a manually operated switch disposed on the exterior surface of the single housing for selectably enabling the plurality of A/C power outlets to receive power.

a smoke detector test switch;

a reset switch to reestablishing power flow to the plurality of A/C power outlets following smoke detection;

one or more light emitting diodes; or means for mounting the power strip to a vertical surface.

6. The power strip of claim 2, wherein the single housing includes at least one reset switch for reestablishing power flow to the plurality of A/C power outlets after a power surge, electrical short or smoke detection.

7. The power strip of claim 1, wherein the single housing further encloses an uninterruptible power source.

8. A power strip comprising:

a power cord having first and second ends, the first end being equipped with two or more prongs for connecting to a power outlet; and a single housing having a plurality of A/C power outlets disposed therein, the single housing enclosing a power source electrically coupled to the second end of the power cord, a smoke detector and a smoke detection control switch.

9. The power strip of claim 8, wherein the single housing further encloses an uninterruptible power source.

10. The power strip of claim 8, wherein the power strip further includes a manually operated switch disposed on the exterior surface of the single housing for selectably enabling the plurality of A/C power outlets to receive power.

11. The power strip of claim 8, wherein the single housing further encloses at least one of surge protection circuitry or a circuit breaker.

12. The power strip of claim 8, wherein the smoke detector is selected from the group comprised of at least one of an ionization sensor smoke detector, a photodiode sensor smoke detector and a beam interference smoke detector.

13. The power strip of claim 8, wherein the single housing further includes at least one of:

ventilation holes suitable to allow smoke to penetrate the single housing;

a smoke detector test switch; a reset switch for reestablishing power flow to the plurality of A/C power outlets following smoke detection; one or more light emitting diodes; or means for mounting the power strip to a vertical surface.

14. A method for automatically terminating power flow to devices equipped to receive power via an A/C power outlet, the method comprising the steps of:

(a) coupling a power strip having a single housing with one or more A/C power outlets disposed therein and enclosing a smoke detector and a smoke detection control switch to an A/C power outlet;

(b) plugging electrically powered devices into the one or more A/C power outlets disposed within the single housing;

(e) detecting smoke by the smoke detector; and (f) creating a trigger voltage that causes the smoke detection control switch to restrict power flow to the one or more A/C power outlets disposed within the single housing.

15. The method of claim 14, wherein the coupling step further comprises the step of employing a power cord having a first end equipped with one or more prongs, and a second end electrically connected to the power strip, to couple the power strip to an A/C power outlet.

* * * * *